US009739040B2

(12) United States Patent
Gnauert et al.

(10) Patent No.: US 9,739,040 B2
(45) Date of Patent: Aug. 22, 2017

(54) SANITARY FITTING

(71) Applicant: Grohe AG, Hemer (DE)

(72) Inventors: Werner Gnauert, Iserlohn (DE); Wulf Woesthoff, Hemer (DE)

(73) Assignee: Grohe AG, Hemer (DE)

( * ) Notice: Subject to any disclaimer, the term of this patent is extended or adjusted under 35 U.S.C. 154(b) by 140 days.

(21) Appl. No.: 14/803,363

(22) Filed: Jul. 20, 2015

(65) Prior Publication Data

US 2015/0322651 A1 Nov. 12, 2015

Related U.S. Application Data

(63) Continuation of application No. PCT/EP2014/000013, filed on Jan. 7, 2014.

(30) Foreign Application Priority Data

Jan. 18, 2013 (DE) ..... 10 2013 000 773

(51) Int. Cl.
*E03C 1/04* (2006.01)
*E03C 1/05* (2006.01)

(52) U.S. Cl.
CPC ..... *E03C 1/0411* (2013.01); *E03C 1/0412* (2013.01); *E03C 1/055* (2013.01); *E03C 2201/45* (2013.01)

(58) Field of Classification Search
CPC ..... E03C 1/0411; E03C 1/0412
USPC ..... 4/675–678
See application file for complete search history.

(56) References Cited

U.S. PATENT DOCUMENTS 5,577,660 A * 11/1996 Hansen ..... G05D 23/1393 236/12.12
6,676,024 B1 * 1/2004 McNerney ..... G05D 23/1393 236/12.12
2014/0259382 A1 * 9/2014 Dobizl ..... E03C 1/046 4/677

FOREIGN PATENT DOCUMENTS

| | | | |
|---|---|---|---|
| DE | 10 2008 006 255 | A1 | 8/2009 |
| EP | 2 472 150 | A1 | 7/2012 |
| EP | 2 672 027 | A1 | 12/2013 |
| WO | WO 94/20784 | A1 | 9/1994 |
| WO | WO 2009/035319 | A1 | 3/2009 |

* cited by examiner

*Primary Examiner* — Huyen Le
(74) *Attorney, Agent, or Firm* — Muncy, Geissler, Olds & Lowe, P.C.

(57) ABSTRACT

A sanitary fitting having at least one first actuating element, in particular for setting the temperature and/or volume of mixed water, and having at least one second actuating element for setting the volume of hot water. In order to set the volume of hot water, a valve element, in particular a solenoid valve, which is electrically controllable by the second actuating element, is arranged in the hot water flow path.

12 Claims, 3 Drawing Sheets

SANITARY FITTING

This nonprovisional application is a continuation of International Application No. PCT/EP2014/000013, which was filed on Jan. 7, 2014, and which claims priority to German Patent Application No. 10 2013 000 773.9, which was filed in Germany on Jan. 18, 2013, and which are both herein incorporated by reference.

BACKGROUND OF THE INVENTION

Field of the Invention

The present invention relates to a sanitary fitting.

Description of the Background Art

A mixer tap, in particular a single-lever mixer tap, may be built into a sanitary fitting for the purpose of adjusting the temperature and/or volume of mixed water; the temperature and/or volume of the mixed water can be adjusted using the actuating lever of the mixer tap. To this end, the mixer tap is attached at its inlet side to a cold water line connected to the water supply system, and to a hot water line. The outlet side of the mixer tap is routed through a mixed water line to the water outlet of the sanitary fitting.

To increase functionality, a sanitary fitting of the generic type can provide, in addition to mixed water, boiling hot water that is routed from a boiler through a separate high-temperature water line to the water outlet of the sanitary fitting. For adjusting the volume of the boiling water, the sanitary fitting has a manually operated, second actuating element, such as a control knob rotatably mounted on the sanitary fitting. A user can rotate this knob into a boiling water position to open the flow path of the boiling water to the water outlet of the sanitary fitting. To this end, a shutoff valve that can be mechanically opened and/or closed with the second actuating element is built into the sanitary fitting.

To further increase functionality, water that has been pretreated in a refrigerating, carbonating, and/or filtering unit can be dispensed through the sanitary fitting.

The abovementioned additional functions of the sanitary fitting are associated with increased use of installation space in the sanitary fitting. Consequently, the sanitary fitting must be made commensurately large, which conflicts with a potentially more compact design of the sanitary fitting.

SUMMARY OF THE INVENTION

It is therefore an object of the present invention to provide a sanitary fitting wherein the sanitary fitting is compact in design despite improved functionality.

The invention is based on the circumstance that the provision of boiling water and/or the provision of mixed water is accomplished mechanically through a mixer tap and/or a high-temperature water shutoff valve, which are manually operated by the user and are built directly into the sanitary fitting. The sanitary fitting should thus provide a commensurately large installation space for the mixer tap and the shutoff valve. Against this background, according to an exemplary embodiment of the invention the volume of boiling water is no longer adjusted through a manually operated shutoff valve, but instead through a valve element, in particular a solenoid valve, that is controlled electrically by the second actuating element. In this way, the second actuating element can continue to be located on the sanitary fitting, whereas the electrically controlled high-temperature water valve element can if desired be located at a distance therefrom, which is to say can even be located outside of the sanitary fitting, for example. By way of example, the valve element can be located in a high-temperature water line upstream of the sanitary fitting in the flow direction.

In an embodiment, a sensor element can be associated with the second actuating element that is capable of electrically detecting the position of the actuating element, for example. The sensor element can be connected to the high-temperature water valve element through a signal line. In the event of an actuating motion of the second actuating element, the sensor element can generate an actuating signal with which the high-temperature water valve element can be controlled. Preferably, the second actuating element can be moved between an off position, in which the high-temperature water valve element is closed, and a boiling water position. In the boiling water position, the high-temperature water valve element is open.

To avoid accidental operation and to provide protection from injury, additional safety measures that prevent unintentional actuation of the high-temperature water valve element are advantageous. For example, the second actuating element can be manually moved from the off position into the boiling water position while building up a restoring force. As a result, the second actuating element is automatically returned to its off position when released.

Alternatively and/or in addition thereto, a locking element can be associated with the second actuating element, for instance a slide movably arranged in the second actuating element. The actuating motion of the second actuating element can be enabled only after actuation of the locking element has taken place.

As an additional safety measure, a timer can be associated with the high-temperature water valve element. By means of the timer, after a period of time has elapsed that can be set at the factory or by the user, for example, the high-temperature water valve element opened by the second actuating element can be automatically closed again. Thus, after this time period has elapsed, the high-temperature water line is disconnected, and this is even the case when the second actuating element is still in its boiling water position.

To further improve functionality, a refrigerating, carbonating, and/or filtering unit can be associated with the sanitary fitting. This unit can be in fluidic connection with the sanitary fitting through a separate supply line. In order to dispense the water pretreated by the unit through filtering, carbonating, and/or chilling, it is preferable to operate the second actuating element. The second actuating element can electronically control the unit through appropriate signal lines. In this way, the second actuating element can perform a dual function, both a volume adjustment for boiling water as well as the adjustment for pretreated water.

The second actuating element can be movable not only between the off position and the boiling water position, but also to at least one other actuating position. In this actuating position, the second actuating element can open the flow path from the above-mentioned treatment unit to the water outlet of the sanitary fitting. In a first actuating position of the second actuating element, specifically chilled and filtered water can be provided, while the chilled water can additionally be dispensed with a different carbonation level in each of its additional actuating positions.

For safety reasons, it is extremely important to prevent unintentional drawing of boiling water. For this reason, it is advantageous for the actuating motion of the second actuating element from the off position to the boiling water position to be opposite its actuating motion from the off position to the at least one additional actuating position. The second actuating element can be a control knob rotatably mounted on the sanitary fixture that can be twisted in mutually opposite directions of rotation into the boiling water position or into the additional actuating position. In this example design, the safety measures can apply solely to an actuating motion of the second actuating element into the boiling water position, but not to an opposite actuating motion into the additional actuating position.

In an embodiment, the high-temperature water valve element is not mechanically adjustable, but instead is electrically controllable. In contrast thereto, adjusting the temperature and/or volume of the mixed water can be accomplished mechanically through a mixer tap, in particular a single-lever mixer tap, that is housed in the sanitary fitting. In this case, the lever of the mixer tap serves as the above-mentioned first actuating element, and the aforementioned control knob serves as the second actuating element. The mixer tap can be attached at its inlet side to a cold water line connected to the water supply system, and to a hot water line. The outlet side of the mixer tap can be connected to a mixed water line that is routed to the water outlet of the sanitary fitting.

A connecting piece can be provided on the inlet side of the water outlet of the sanitary fitting that has a first connecting port for the high-temperature water line, a second connecting port for the mixed water line, and/or a third connecting port for the supply line from the refrigerating, carbonating, and/or filtering unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
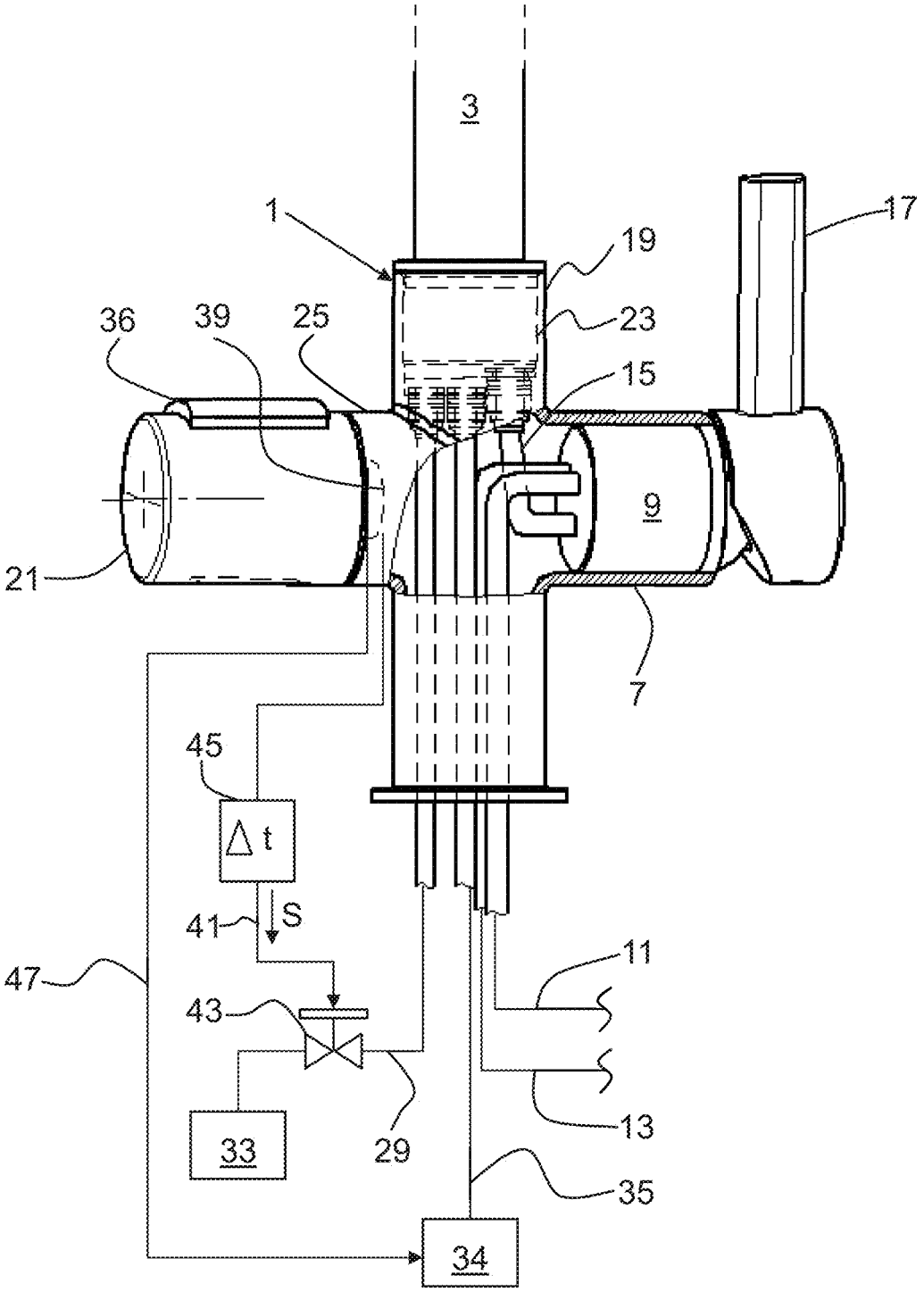
FIG. 1 is a perspective, partial cross-sectional view of a sanitary fitting with an additional block diagram indicating the water flow paths to the sanitary fitting.
Figure 2:
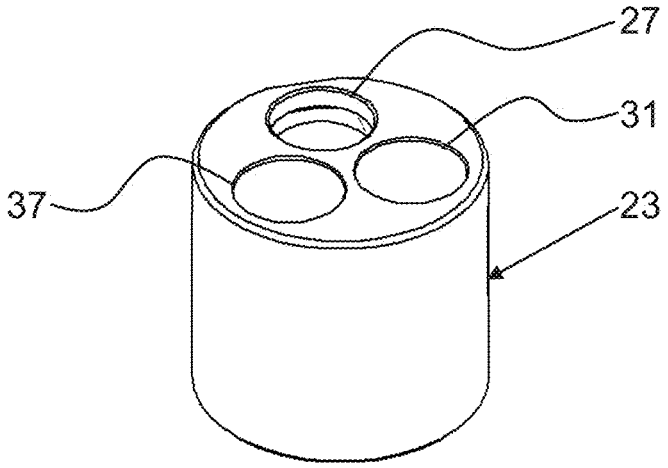
FIG. 2 is a perspective, detail view of a connecting piece of the sanitary fitting.

FIG. 1 shows a perspective view of a sanitary fitting with a fitting body 1 and a water outlet 3. In an installation position, the cross-shaped fitting housing 1 of the sanitary fitting is placed on a mounting hole in a kitchen countertop (not shown), through which the below-described water lines are routed to the water outlet 3 of the sanitary fitting. In the right-hand side of FIG. 1, the fitting housing 1 has a mounting adapter 7 in which is placed a single-lever mixer tap 9. Viewed in the direction of flow, the mixer tap 9 is connected on the inlet side to a cold water line 11 and to a hot water line 13, which are routed to a water supply system that is not shown. On the outlet side, the mixer tap 9 is connected to a mixed water line 15, which carries the mixed water to the water outlet 3. The temperature and/or volume of the mixed water is adjusted in a manner known per se through appropriate rotary and/or tilting motions of the operating lever 17 of the mixer tap 9. Horizontally opposite the mixer tap 9, another mounting adapter 19 is provided in which a control knob 21, as the second actuating element, is rotatably mounted.

The mixed water line 15 connected to the mixer tap 9 is in plug-in connection with a first connecting port 27 provided in a connecting piece 23. The connecting piece 23 is indicated in FIG. 1 in a mounting adapter 25, vertically open toward the top, of the fitting body 1, specifically at the inlet side of the water outlet 3.

In addition, a high-temperature water line 29 is provided separately from the mixed water line 15. The high-temperature water line 29 is inserted in a second connecting port 31 of the connecting piece 23, and is routed to a boiler 33 provided below the kitchen countertop. In addition to the boiler 33, a refrigerating, carbonating, and/or filtering unit 34 is provided in which fresh water can be filtered, chilled, and/or carbonated. The unit 34 is fluidically connected to the sanitary fitting by a supply line 35, and at its upper end is in plug-in connection with a third connecting port 37 of the connecting piece 23.

As is also evident from FIG. 1, a sensor element 39 for detecting the angle of rotation of the control knob 21 is provided in the mounting adapter 19. The sensor element 39 stands in signal connection with a solenoid valve 43 through a signal line 41. The solenoid valve 43 is located outside of the sanitary fitting, which is to say a distance ahead of the sanitary fitting in the direction of flow.

Moreover, a timer 45 is connected ahead of the solenoid valve 43 by a signaling device. By means of the timer 45, after a period of time $\Delta t$ has elapsed that can be set at the factory or by the user, for example, the solenoid valve 43 opened with the control knob 21 can be automatically closed again. After this time period $\Delta t$ has elapsed, the high-temperature water line 29 is disconnected, and this is even the case when the control knob 21 is still in its boiling water position H.

Power to the above-mentioned electrical components can be supplied through the unit 34, for example. The sensor element 39 is connected to the unit 34 via an additional signal line 47. In FIG. 1, the two signal lines 41, 47 run outside the sanitary fitting for reasons of clarity. In the actual installation situation, however, the signal lines 41, 47 are installed inside the sanitary fitting.

Figure 3:
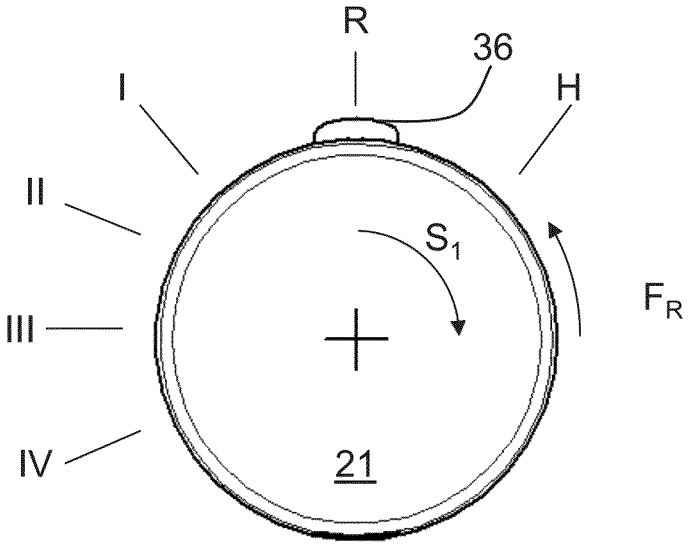
FIG. 3 is schematic representations used to indicate the actuating motions of the second actuating element.

As is shown in FIG. 3, the control knob 21 can moved clockwise from its off position R into a boiling water position H in a first actuating motion $S_1$. For safety reasons, a slide 36 is mounted in the control knob 21. To enable the above actuating motion $S_1$ of the control knob 21, the slide 36 must first be actuated. The actuating motion $S_1$ takes place with the buildup of a restoring force $F_R$, for instance by means of a spring that is not shown. This ensures that the control knob 21 is automatically returned to its off position R when released.

As a result of the actuating motion $S_1$ of the control knob 21 into its boiling water position H indicated in FIG. 3, the sensor element 39 generates a signal S that turns on the solenoid valve 43. Simultaneously with the generation of the signal S, the timer 45 is activated. The timer 45 closes the solenoid valve after a predetermined time period $\Delta t$ has elapsed. This takes place even if the control knob 21 is still in its boiling water position.

Figure 4:
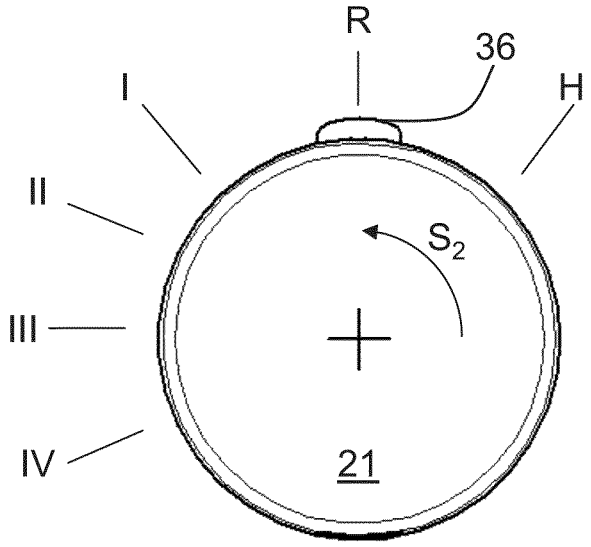
FIG. 4 is schematic representations used to indicate the actuating motions of the second actuating element.

In a counterclockwise actuating motion $S_2$ that is opposite the first actuating motion $S_1$, the control knob 21 can be moved into additional actuating positions I to IV as indicated in FIG. 4. In the actuating position I, by way of example, chilled and filtered water can be drawn from the unit 34 through the sanitary fitting. In contrast, filtered/chilled water can be dispensed with a different carbonation level in each of the additional actuating positions II through IV.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A sanitary fitting comprising:

at least one first actuating element for adjusting a temperature and/or volume of mixed water;

at least one second actuating element for adjusting a volume of boiling water; and a valve element that is controllable electrically by the second actuating element and is arranged in a high temperature water line for adjusting the volume of the boiling water, wherein a sensor element, that is connected to the valve element through a signal line, is associated with the second actuating element, and wherein the sensor element generates an actuating signal for controlling the valve element when the second actuating element is actuated.

2. The sanitary fitting according to claim 1, wherein the valve element is arranged upstream of the sanitary fitting in a flow direction and/or outside of the sanitary fitting in the high-temperature water line.

3. The sanitary fitting according to claim 1, wherein the second actuating element is moveable between an off position, in which the valve element is closed, and a boiling water position, in which the valve element is open, and wherein the second actuating element is moveable in an actuating motion from the off position into the boiling water position while building up a restoring force so that the second actuating element automatically returns to the off position when released.

4. The sanitary fitting according to claim 3, wherein a refrigerating, carbonating, and/or filtering unit is provided that is in fluidic connection with the sanitary fitting through a supply line, and wherein the unit is electrically controlled by the second actuating element for adjustment of the water supplied by the unit.

5. The sanitary fitting according to claim 4, wherein the second actuating element is moveable into at least one additional actuating position with which the flow path from the unit to an outlet of the sanitary fitting is opened.

6. The sanitary fitting according to claim 1, wherein a locking element or slide is associated with the second actuating element that is movably arranged in the second actuating element and that is actuated to enable an actuating motion of the second actuating element.

7. The sanitary fitting according to claim 1, wherein a mixer tap or a single-lever mixer tap is provided for adjusting the temperature and/or volume of mixed water, the tap being housed in the sanitary fitting, and/or wherein a lever of the tap is the first actuating element.

8. The sanitary fitting according to claim 7, wherein the mixer tap is attached at an inlet side to a cold water line and to a hot water line and at an outlet side to a mixed water line that is routed to an outlet of the sanitary fitting.

9. The sanitary fitting according to claim 1, wherein, provided in the sanitary fitting upstream of an outlet of the sanitary fitting, a connecting piece is arranged that has a first connecting port for a mixed water line, a second connecting port for the high temperature water line, and/or a third connecting port for a supply line from a refrigerating, carbonating, and/or filtering unit.

10. The sanitary fitting according to claim 1, wherein the valve element is a solenoid valve.

11. A sanitary fitting comprising:

at least one first actuating element for adjusting a temperature and/or volume of mixed water;

at least one second actuating element for adjusting a volume of boiling water; and a valve element that is controllable electrically by the second actuating element and is arranged in a high temperature water line for adjusting the volume of the boiling water, wherein a timer is associated with the valve element via which the valve element opened by the second actuating element automatically closes after a predetermined time period has elapsed.

12. A sanitary fitting comprising:

at least one first actuating element for adjusting a temperature and/or volume of mixed water;

at least one second actuating element for adjusting a volume of boiling water; and a valve element that is controllable electrically by the second actuating element and is arranged in a high temperature water line for adjusting the volume of the boiling water, wherein the second actuating element is moveable between an off position, in which the valve element is closed, and a boiling water position, in which the valve element is open, and wherein the second actuating element is moveable in an actuating motion from the off position into the boiling water position while building up a restoring force so that the second actuating element automatically returns to the off position when released, wherein a refrigerating, carbonating, and/or filtering unit is provided that is in fluidic connection with the sanitary fitting through a supply line, and wherein the unit is electrically controlled by the second actuating element for adjustment of the water supplied by the unit, wherein the second actuating element is moveable into at least one additional actuating position with which the flow path from the unit to an outlet of the sanitary fitting is opened, and wherein the actuating motion of the second actuating element into the boiling water position and an actuating motion of the second actuating element into the additional actuating positions are opposite one another.

* * * * *